US005518427A

United States Patent [19]

Kan et al.

[11] Patent Number: 5,518,427

[45] Date of Patent: May 21, 1996

[54] PIN HEADER

[75] Inventors: Meng Kuang Kan; Nam Fong Chew, both of Singapore, Singapore

[73] Assignee: E. I. Du Pont de Nemours and Company, Wilmington, Del.

[21] Appl. No.: 405,923

[22] Filed: Mar. 16, 1995

Related U.S. Application Data

[63] Continuation of Ser. No. 89,413, Jul. 9, 1993, abandoned, which is a continuation of Ser. No. 898,581, Jun. 15, 1992, abandoned.

[30] Foreign Application Priority Data

Jun. 14, 1991 [JP] Japan ..... 3-143554

[51] Int. Cl.[6] ..... H01R 13/405

[52] U.S. Cl. ..... 439/736; 439/936; 439/876; 439/276

[58] Field of Search ..... 439/736, 876, 439/936, 276, 688

[56] References Cited

U.S. PATENT DOCUMENTS 4,775,333 10/1988 Grider et al. ..... 439/736

4,976,634 12/1990 Green et al. ..... 439/936 X 5,032,085 7/1991 Alwine et al. ..... 439/936 X

FOREIGN PATENT DOCUMENTS 0591681 8/1947 United Kingdom .

0744277 2/1956 United Kingdom .

0872780 7/1961 United Kingdom .

*Primary Examiner*—David L. Pirlot

*Assistant Examiner*—Jill DeMello

*Attorney, Agent, or Firm*—Woodcock Washburn Kurtz Mackiewicz & Norris

[57] ABSTRACT

A pin-header comprises a one-piece molded insulator and metal pins extending through the insulator. One surface of the insulator has a first recess having and a plurality of second recesses are provided each at an area between the inner wall surface of an insertion hole and the outer peripheral surface of the pin with each pin inserted in the insertion hole. A sealant is filled in the first and second recesses of the insulator.

3 Claims, 2 Drawing Sheets

PIN HEADER

This is a continuation of application Ser. No. 089,413, filed Jul. 9, 1993, now abandoned, which was a continuation of Ser. No. 898,581, filed Jun. 15, 1992, now abandoned.

BACKGROUND OF THE INVENTION

1. Field of the Invention

This invention relates to a pin-header for use in modern business machine, computer equipment and the like and, in particular, a pin-header to be mounted an airtight sealed casing.

2. Description of the Related Art

A pin-header of such an internal mount type comprises a housing having metal pins extending through the housing.

The melting point of insulating plastics of which the housing of the pin-header is made is generally equal to, or lower than, the soldering temperature. For this reason, care has to be taken to prevent a slippage of the pin from the housing resulting from heat upon soldering. Further, it is necessary to prevent an inflow of a flux which is used upon soldering into an area of contact with the pin.

As the internal mount type connection, an airtight seal connection type is known which has to strictly prevent temperature, humidity and so on from intruding from an outside. This connection type is used to make connection, for example, between a printed-circuit board sealed in a casing, such as a disc drive unit in a modern business machine or a computer equipment and an external power supply unit or a signal processing unit. In the pin-header of this connection type, high airtight seal is required at those insertion holes of a housing where associated pins are held relative to the housing.

Conventionally, there is a high demand for a pin-header which satisfies all the mounting requirements or manufacturing requirements as set out above. In order to satisfy these requirements, a countermeasure as will be set out below has to be taken. That is, in a pin-header comprising a housing having insertion holes and molded as such with the use of a thermoplastic resin and pins each inserted through an associated through hole, a resin sealant is filled, for example, at an area between the internal wall surface of the insertion hole and the outer peripheral surface of the pin so as to prevent defective contact resulting from the inflow of a flux into that contact area upon soldering.

This method offers no effective solution to the aforementioned problem became it is not possible to prevent a slippage of the pin out of the housing's insertion hole or to prevent an intrusion of temperature, humidity, dirt, etc., into the insertion hole. It is, therefore, not yet possible to provide a connector satisfying all the requirements as already set out above.

Further, there is also a demand for an internal mount type pin-header which can be made lower in manufacturing cost while solving the aforementioned problems.

SUMMARY OF THE INVENTION

It is accordingly the object of the invention to provide a pin-header which can solve its mounting and manufacturing problems, that is, prevent a slippage of a pin out of its housing resulting from heat upon soldering and prevent defective contact resulting from the inflow of a flux into a pin area upon soldering and can ensure high airtight seal and can achieve a reduced manufacturing cost.

According to the invention, the object is achieved by a pin-header comprising an insulating housing having opposed surfaces defined by peripheral edges of the housing and conductive pins extending through the opposed surfaces and holes for accommodating the conductive pins, characterized in that the one surface of the housing having a first recess defined by the peripheral edges of the one surface, the first recess having second recesses around the conductive pins, an insulating resin being filled in the first and second recesses.

According to an embodiment of the invention, the horizontal cross-sectional area of the hole is greater at least near the one surface of the housing than the horizontal cross-sectional area of the conductive pin, so as to form the second recess.

According to this pin-header, since the insulating resin is filled in the first recess of the housing, there is no possibility that the insulating resin will be overflowed out of the housing. Further, the insulating resin is also filled in the second recesses around the pins and the heat transmission from the pin to the housing, for example, upon soldering is suppressed with the presence of the insulating resin.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
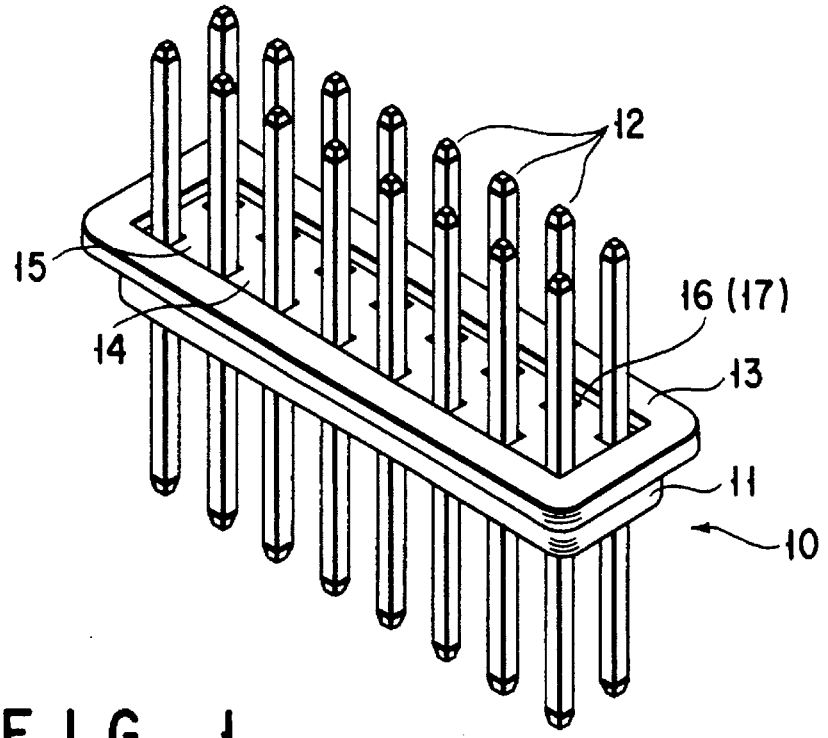
FIG. 1 is a perspective view showing a pin-header according to the invention.

FIG. 1 shows a pin-header according to the invention. The pin-header 10 as shown comprises an insulator 11 having conductive pins 12 extending through opposed surface of the insulator 11.

The insulator or insulating housing 11 is formed, as a molded body, using a thermoplastic insulating resin, such as PBT (polybutylene-terephthalate), nylon, PPS (polyphenylene sulfide)and PET (polyethylene-terephthalate). A flange 13 is provided on the outer peripheral edge of the insulator 11 such that it extends in a direction perpendicular to the longitudinal of the pin 12. When the pin-header 10 is fitted into an associated mating area of a mount member on the "casing" side so that connection is made to a printed board (not shown) in the airtight sealed casing, the flange 13 cooperates with the mount member to provide an airtight of the casing.

A pin holding section 14 is provided at the central area of the insulator 11 with a plurality of insertion holes 16 provided at its predetermined places to correspond to the pin 12. The pin holding section 14 is formed as a recess 15 of a predetermined depth as measured from the top surface of the flange 13. The recess 15 is defined by the edge portion, that is, the flange of the insulator 11.

The pin or post 12 is made of brass plated with, for example, tin or gold. The pins 12, each, are inserted into the corresponding insertion hole 16 in the pin holding section 14 and fitted in place. In the neighborhood of the surface of the insulator 11, the open end portion of the insertion hole 16 is made greater than the cross-sectional area of the pin contact 12 taken in a direction perpendicular to the longitudinal direction. In this way, a recess or relief 17 is formed in the inner wall surface portion of the insertion hole 16. The recess 17 provides a spacing extending in the longitudinal direction of the pin 12 at an area between the inner wall surface of the insertion hole 16 and the outer peripheral surface of the pin 12.

Figure 2:
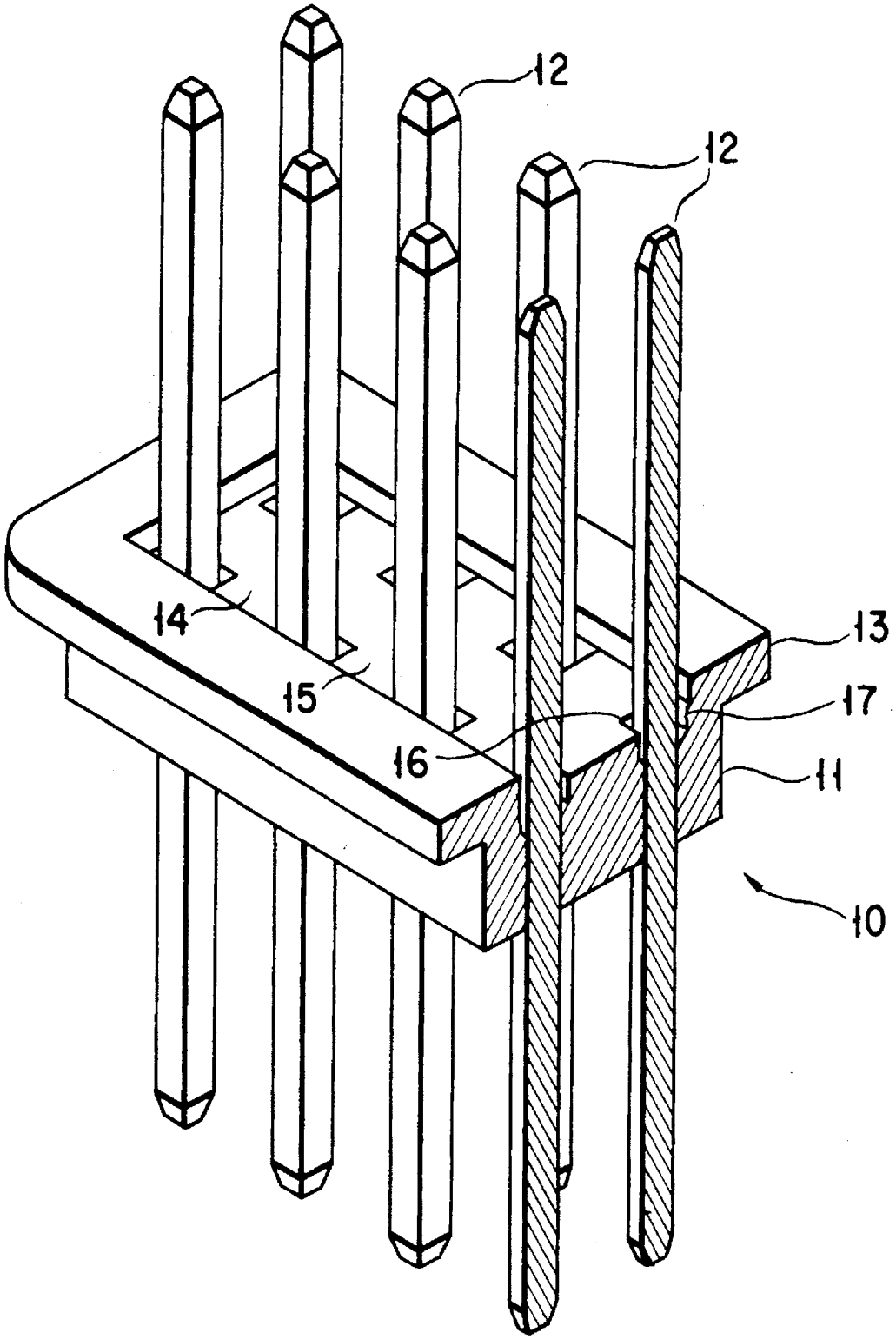
FIG. 2 is a perspective view in cross-section showing a major portion of the pin-header of FIG. 1.

FIG. 2 shows, in more detail, a structure of the pin-header 10 shown in FIG. 1. As shown in FIG. 2, the inner wall surface of the recess 17 of the insertion hole 16 in the insulator 11 is tapered from the surface of the recess 15 of the insulator 11 toward that area where the pin 12 is fitted in place by a compression force acting in the inside of the through hole 16.

The spacing between the outer peripheral surface of the pin 12 and the inner wall surface of the insertion hole 16 is so dimensioned that it can adequately accommodate the difference in expansion coefficient between the pin 12 and the insulator 11 as resulting from heat upon soldering during the filling of sealant into that spacing as will be set forth below and/or resulting from heat generated in the device through conductive transfer from the printed-circuit board to be connected. The spacing size has to be determined, taking into consideration the material of the pin 12 as well as the properties of the insulating material of the insulator 11, in particular, its expansion property involved by heat, water or humidity absorption.

Figure 3:
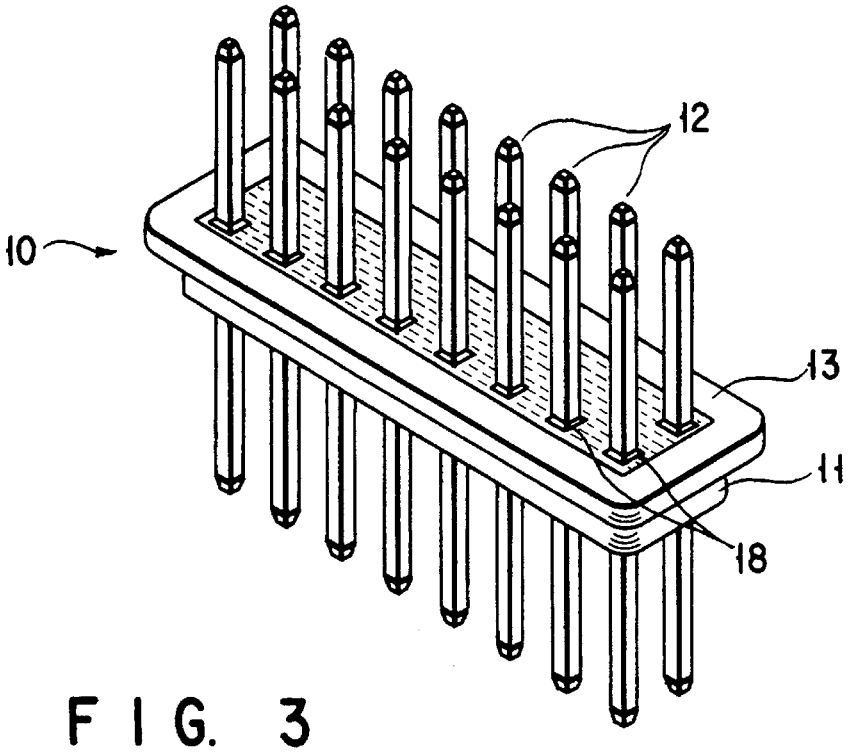
FIG. 3 is a perspective view showing the pin-header with the recess and relief around the pins filled with a sealant.

In the pin-header 10 as shown in FIGS. 1 and 2, a resin excellent in dimensional stability and heat-resistance, such as an acrylate epoxy urethane resin commercially available under a trade name of Quik-Cure manufactured by E. I. Du Pont de Nemours & Co., is filled, as the sealant, in the body recess and in the recess 17 provided in the inner wall of the insertion hole 16 as shown in FIG. 3.

The sealant 18 is fully and positively flowed into the recess 17 defined between the outer peripheral surface of each pin 12 and inner wall surface of the insertion hole 16.

A satisfactory solution to this requirement is to perform the process of a flow of the sealant 18 by causing a negative pressure to occur in a suction direction upon the manufacture of the pin-header 10 to allow the sealant of a molten state to be sucked in the aforementioned taper direction of the recess 17 with the sealant 18 positively filled in the recess 15 of the insulator 11, it is heated and cured. As the method of heating, the pin-header 10 with the sealant 18 flowed as set out above passes through an oven where the sealant is exposed to, for example, ultraviolet radiation.

Since it is in the recess 15 of the insulator that the sealant is flowed (injected), no sealant is overflowed from the pin-header 10. It is, therefore, possible to prevent defective contact of the sealant 18 with the pins 12.

Although, in the aforementioned embodiment, the acrylate epoxy urethane resin has been explained as being used as the sealant 18, the present invention is not restricted thereto. For example, use can be made, as the sealant, of not only the acrylate epoxy urethane resin but also an acrylic resin (thermoplastic resin), epoxy resin, urethane resin (thermosetting resin) or a mixture thereof or silicone, etc.

It is desirable from the standpoint of a manufacturing cycle that a resin for use as the sealant be cured for a brief period of time under a relatively low temperature. It is also desirable to use a resin material excellent in dimensional stability against the temperature, humidity, or other circumferential variations.

According to the pin-header of the present invention, the recess 15 is provided in the insulator 11 and filled with an insulating resin at which time the insulating resin is not overflowed from the insulator 11. Hence, a resultant connector can prevent defective contact with each pin 12.

Further, in the interior of the insertion hole for the pin 12, the recess 17 is provided at an area between the inner wall surface of the insertion hole 16 and the outer peripheral surface of the pin contact and filled with the insulating resin. As a result, high airtight seal is maintained at the area of the hole 16 and the transmission of heat from the pin 12 to the housing upon, for example, soldering is inhibited by the insulating resin, preventing a slippage of the pin contact out of the insulator 11.

Further, the insulator 11 can be one-piece molded with the recess 17 of each through hole 16 and recess 15 of the insulator 11 provided. Thus a resultant connector is easier to manufacture and low in manufacturing cost.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electrical connector comprising a housing of insulating material having first and second surfaces, said first surface having a peripheral edge defining a recessed portion of said first surface, said first surface for mounting with a mounting member for connection to a printed circuit board such that an airtight seal is formed between said first surface and the mounting member, said housing further having a plurality of apertures formed in said recessed portion of said first surface and extending to said second surface, each said aperture adapted to receive an electrically conductive pin terminal which extends through said aperture and has ends extending from said first and second surfaces, a part of each said aperture formed near said first surface having a larger cross section than the remainder of said aperture, said part also having at least a portion of its walls tapered to decrease said cross section as said walls extend away from said first surface, and an insulating resin disposed in said recessed portion of said first surface and in the parts of the aperture formed in said first surface so that when heated, said resin flows and fills the tapered wall portion of each aperture thereby acting as a sealant around each pin terminal, said recessed portion having a sufficiently small depth such that said insulating resin fills a substantial portion of said recessed portion and such that said insulating resin is substantially flush with the mounting member, whereby said insulating resin prevents said pin terminals from becoming loosened during soldering.

2. The electrical connector of claim 1 wherein resin is an acrylate epoxy urethane resin, an acrylic resin, an epoxy resin, a urethane resin or a mixture thereof.

3. An electrical connector comprising a housing of insulating material having first and second surfaces, said first surface having a peripheral edge defining a recessed portion of said first surface, said first surface for mounting with a mounting member for connection to a printed circuit board such that an airtight seal is formed between said first surface and the mounting member, said housing further having a plurality of apertures formed in said recessed portion of said first surface and extending to said second surface, each said aperture adapted to receive an electrically conductive pin terminal which extends through said aperture and has ends extending from said first and second surfaces, a part of each said aperture formed near said first surface having a larger cross section than the remainder of said aperture, said part also having at least a portion of its walls tapered to decrease said cross section as said walls extend away from said first surface, and an insulating resin disposed in said recessed portion of said first surface and in the parts of the aperture formed in said first surface so that when heated, said resin flows and fills the tapered wall portion of each aperture thereby acting as a sealant around each pin terminal, said recessed portion having a bottom surface, the portion of the housing forming said recessed portion being continuous from said peripheral edge to said bottom surface, said recessed portion having a sufficiently small depth such that said insulating resin fills a substantial portion of said recessed portion and such that said insulating resin is substantially flush with the mounting member, whereby said insulating resin prevents said pin terminals from becoming loosened during soldering.

* * * * *